United States Patent [19]

Ramsey

[11] Patent Number: 4,813,656

[45] Date of Patent: Mar. 21, 1989

[54] GRID FRAME

[75] Inventor: Henry R. Ramsey, Dudley, Mass.

[73] Assignee: Webster Spring Co. Inc., Oxford, Mass.

[21] Appl. No.: 45,424

[22] Filed: May 1, 1987

[51] Int. Cl.[4] ..... F16F 3/02; H47C 23/02

[52] U.S. Cl. ..... 267/80; 267/97; 5/247

[58] Field of Search ..... 267/80, 85, 97, 110, 267/73; 5/259 R, 259 B, 247, 266, 275

[56] References Cited

U.S. PATENT DOCUMENTS 719,155 1/1903 Smith ..... 5/266

2,541,468 2/1951 Ebert ..... 267/97

4,339,834 7/1982 Mizelle ..... 5/247 X

FOREIGN PATENT DOCUMENTS 0936629 11/1973 Canada ..... 267/80

*Primary Examiner*—Andres Kashnikow

*Assistant Examiner*—Richard Potosnak

*Attorney, Agent, or Firm*—Robert T. Gammons

[57] ABSTRACT

A grid frame for a spring assembly comprising a border wire transversely and longitudinally-crossing line wires, and spring wires disposed between adjacent line wires either transversely of the frame or longitudinally thereof.

4 Claims, 1 Drawing Sheet

GRID FRAME

BACKGROUND OF THE INVENTION

Grid frames for spring assemblies heretofore have comprised a generally rectangular border wire to which are attached spaced, parallel, longitudinally and transversely-extending grid or line wires. It is the purpose of this invention to reinforce a grid frame of the foregoing kind with spring wires interposed between adjacent line wires to add springiness to the frame.

SUMMARY OF THE INVENTION

A grid frame for a spring assembly wherein the grid frame is supported above and connected to the base frame by spring modules and wherein the grid frame has, in addition to the border wire and crossing grid or line wires, additional spring wires disposed between adjacent line wires. The spring wires may be disposed either transversely of the frame or longitudinally thereof. The additional spring wires are so disposed as to afford reinforcement and springiness to the grid frame and, desirably, are so disposed as to be tangent to the underside of a plane tangent to the upper sides of the line wires. To effect such tangency, the line wires contain depressions of arcuate configuration for receiving the spring wires, the depressions being of greater than half the diameter of the line wires such as to anchor the spring wires to the line wires.

The invention will now be described in greater detail with reference to the accompanying drawings, wherein.

The invention as herein illustrated is concerned with an improved grid frame 10 for a spring assembly of the kind wherein there is a base frame, a grid frame and spring modules disposed between them and connecting them to each other, not specifically shown herein.

Figure 1:
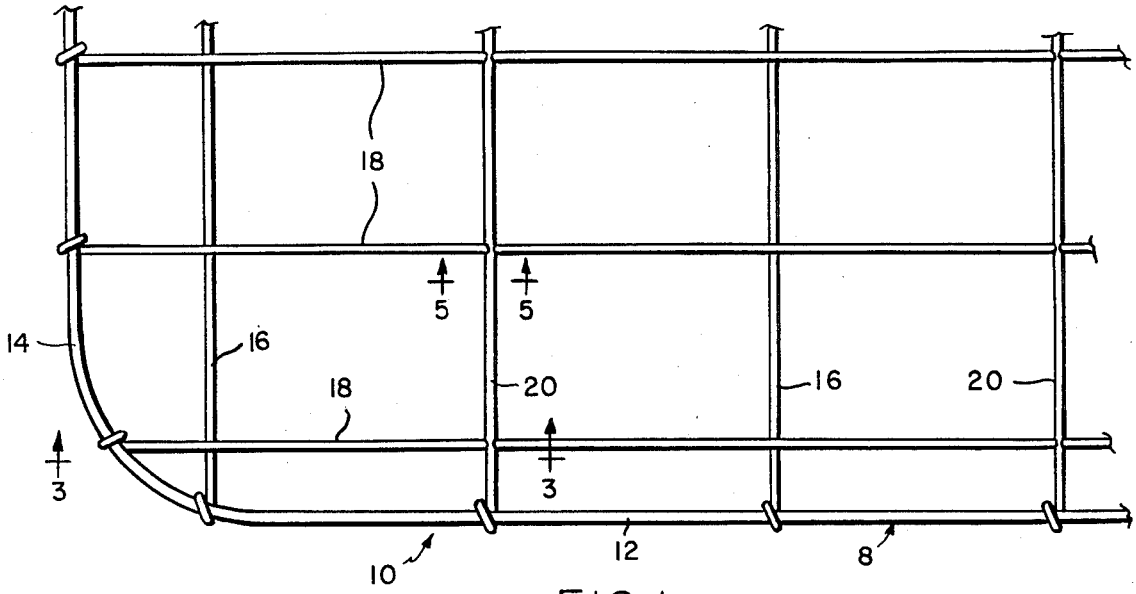
FIG. 1 is a fragmentary plan view of a portion of a grid frame showing conventional crossing line wires and spring wires extending transversely of the grid frame.

Referring specifically to FIG. 1, the grid frame 10 comprises a border wire 8 of continuous length which provides sides 12 and ends 14. Between the sides 12 and ends 14 are disposed spaced, parallel crossing grid or line wires 16 and spaced, parallel crossing grid or line wires 18.

Figure 5:
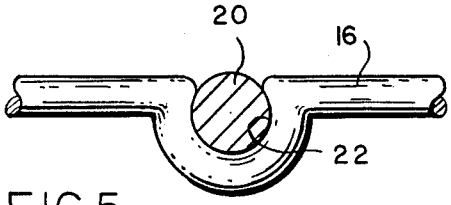
FIG. 5 is an enlarged fragmentary elevation taken on the line 5—5 of FIG. 1.

In accordance with this invention, the crossing line wires 16 and 18 are supplemented by crossing wires 20, the latter being comprised of spring wire. The crossing spring wires 20 are of generally larger gauge than the crossing line wires 16 and 18 and, in accordance with this invention, are disposed in deviations 22 formed in the crossing line wires 16 and 18. The deviations 22, as shown in FIG. 5, are of a depth to receive the entire diameter of the spring wires 20 so that the tops of the spring wires 20 are tangent to the tops of the line wires 18. As illustrated in FIG. 5, the deviations 22 are greater than half the circular diameter of spring wires 20 so that they have contact with the spring wires above the centers thereof and thus anchor the spring wires 20 to the line wires 18.

Figure 2:
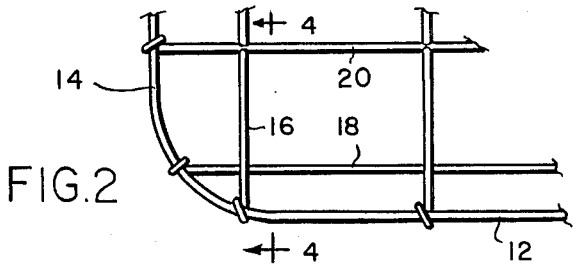
FIG. 2 is a view similar to FIG. 1 wherein the spring wires extend longitudinally of the grid frame.
Figure 3:
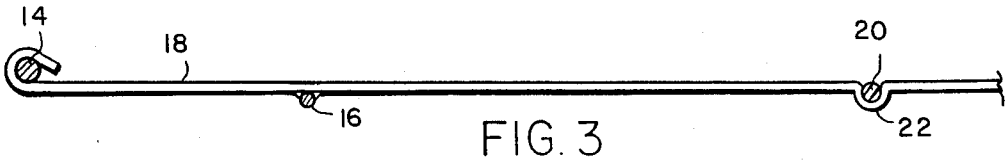
FIG. 3 is a view taken on the line 3—3 of FIG. 1 to a larger scale.
Figure 4:
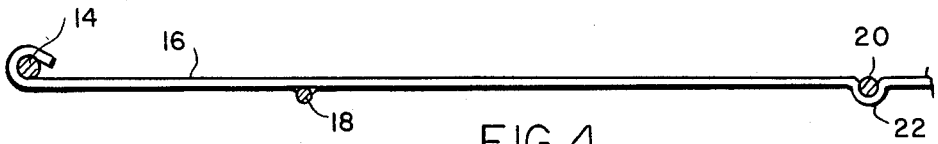
FIG. 4 is a view taken on the line 4—4 of FIG. 2 to a larger scale.

The spring wires 20 are shown in FIGS. 1 and 3 as disposed transversely of the grid frame with their ends wrapped about the sides 12. However, it is within the scope of the invention to dispose the spring wires longitudinally of the grid frame with their ends wrapped about the ends 14, as shown in FIGS. 2 and 4. Desirably, the crossing line wires 16 are 14 gauge and the crossing wires 18 are 12 gauge. The border wire is 6 gauge and the spring wires 9 gauge. However, the spring wires can vary between 3 and 14 gauge.

The line wires are welded to each other at their crossing whereas the spring wires can be inserted in the basic wire welded grid without welding.

The grid frame thus constructed provides for greater resiliency and spring than a conventional frame wherein the crossing wires are not specifically structured to provide for springiness and the structure is unique in that it enables incorporating the spring wires into the base frame without welding in the plane of the crossing line wires and so that the spring wires are resistant to displacement longitudinally and/or transversely of the frame.

It should be understood that the present disclosure is for the purpose of illustration only and includes all modifications or improvements which fall within the scope of the appended claims.

What is claimed is:

1. A rectangular grid frame consisting a border wire embodying longitudinally-spaced, parallel, transverse ends and transversely-spaced, parallel, longitudinal sides; spaced, parallel, transversely-extending, rectilinear line wires disposed transversely of the grid frame in a common plane and connected at their opposite ends to the spaced, parallel, longitudinal sides of the grid frame; spaced, parallel, longitudinally-extending line wires disposed longitudinally of the grid frame in a common plane above the plane of the transverse line wires and connected at their opposite ends to the spaced, parallel ends of the grid frame, said transverse line wires being tangential to the undersides of the longitudinal line wires at their crossings and rectilinear spring wires disposed transversely of the grid frame, transversely of the longitudinal line wires, and between and parallel to the transverse line wires, said longitudinal line wires containing downwardly-disposed deviations at their intersection with the spring wires within which the spring wires are lockingly received, said deviations being of such depth that the tops of the spring wires are in a plane tangent to the tops of the longitudinal line wires and wherein the ends of the spring wires are connected to the longitudinal sides of the frame and each said spring wire is uniformly rectilinear along the entire length extending between the connected ends of each said spring wire.

2. A grid according to claim 1 wherein the border wire is 6 gauge and the spring wires are 9 gauge.

3. A grid according to claim 1 wherein the line wires longitudinally of the frame are 12 gauge.

4. A grid according to claim 1 wherein the line wires transversely of the frame are 14 gauge.

* * * * *